US008966931B2

(12) United States Patent
Yang

(10) Patent No.: US 8,966,931 B2
(45) Date of Patent: Mar. 3, 2015

(54) REFRIGERATOR AND ICEMAKER WITH LEVER ASSEMBLY

(75) Inventor: Chang-Woan Yang, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 1552 days.

(21) Appl. No.: 12/300,311

(22) PCT Filed: Jul. 11, 2007

(86) PCT No.: PCT/KR2007/003363

§ 371 (c)(1),
(2), (4) Date: Nov. 10, 2008

(87) PCT Pub. No.: WO2008/007901

PCT Pub. Date: Jan. 17, 2008

(65) Prior Publication Data

US 2009/0151386 A1 Jun. 18, 2009

(30) Foreign Application Priority Data

Jul. 11, 2006 (KR) ..... 10-2006-0064874

(51) Int. Cl.

| | |
|---|---|
| ***F25D 19/00*** | (2006.01) |
| ***F25D 3/02*** | (2006.01) |
| ***F25D 11/02*** | (2006.01) |
| ***F25D 23/04*** | (2006.01) |
| ***F25D 23/02*** | (2006.01) |

(52) U.S. Cl.

CPC ..... *F25D 23/04* (2013.01); *F25D 23/025* (2013.01); *F25C 2400/10* (2013.01); *F25D 2317/062* (2013.01); *F25D 2323/021* (2013.01); *F25D 2400/04* (2013.01)

USPC ..... 62/449; 62/420; 62/441; 62/447

(58) Field of Classification Search

USPC ..... 62/449, 420, 441; 70/78–84; 292/57, 292/113, 196, 217, 263

See application file for complete search history.

(56) References Cited

U.S. PATENT DOCUMENTS

| | | | | |
|---|---|---|---|---|
| 1,862,715 | A * | 6/1932 | Solliday et al. | 292/244 |
| 4,413,848 | A * | 11/1983 | Leaver et al. | 292/59 |
| 5,265,921 | A * | 11/1993 | Nikitas et al. | 292/145 |
| 2005/0257536 | A1 * | 11/2005 | Chung et al. | 62/135 |
| 2006/0086130 | A1 * | 4/2006 | Anselmino et al. | 62/344 |
| 2006/0086132 | A1 * | 4/2006 | Maglinger et al. | 62/344 |
| 2006/0096310 | A1 | 5/2006 | Lee | |
| 2006/0152125 | A1 * | 7/2006 | Anderson et al. | 312/406.2 |
| 2006/0260344 | A1 * | 11/2006 | Martin et al. | 62/340 |

FOREIGN PATENT DOCUMENTS

| | | | |
|---|---|---|---|
| CN | 1773199 | A | 5/2006 |
| EP | 1 559 973 | A1 | 8/2005 |
| EP | 1 580 504 | A2 | 9/2005 |
| JP | 61-150970 | U | 9/1986 |
| JP | 63-142682 | U | 9/1988 |

(Continued)

*Primary Examiner* — Judy Swann
*Assistant Examiner* — Zachary R Anderegg
(74) *Attorney, Agent, or Firm* — Birch, Stewart, Kolasch & Birch, LLP

(57) ABSTRACT

A refrigerator is provided. The refrigerator includes: an icemaker case on a door; an icemaker door on the icemaker case, the icemaker door being rotatable; a holding part on the icemaker case; and a lever assembly. The lever assembly is coupled to the icemaker door to be rotatable in order to engage or disengage with the holding part.

7 Claims, 4 Drawing Sheets

(56) References Cited

FOREIGN PATENT DOCUMENTS

| | | | |
|---|---|---|---|
| KR | 20-1999-0029025 | U | 7/1999 |
| KR | 10-2006-0041513 | A | 5/2006 |
| KR | 10-0688659 | B1 | 2/2007 |

* cited by examiner

REFRIGERATOR AND ICEMAKER WITH LEVER ASSEMBLY

TECHNICAL FIELD

The present disclosure relates to a refrigerator.

BACKGROUND ART

A related art refrigerator is an appliance that cools its contents to a temperature below an ambient temperature. The refrigerator provides cold air generated by means of a refrigerant cycle to its storage compartments. The storage compartments consist of a freezer compartment and a refrigeration compartment.

The freezer may include an icemaker used to make ice. The icemaker may be disposed in the door of the refrigeration compartment or in the freezer.

However, when the freezer is disposed at the lower part of a main body of the refrigerator, the icemaker is also disposed in the lower part of the main body. In this case, a user needs to stoop to get ice from the icemaker.

Additionally, the related art refrigerator has a freezer with a significantly smaller capacity than that of the refrigeration compartment. Therefore, when an icemaker is installed in such a freezer with a relatively small capacity, the capacity of the freezer is further decreased, so that the freezer of the refrigerator is unable to meet the needs of a user.

DISCLOSURE OF INVENTION

Technical Problem

Embodiments provide an opening and closing structure of an icemaker case in a refrigerator, in which an icemaker door is equipped at the icemaker case on a door of the refrigerator, thereby providing an independent icemaker space.

Embodiments also provide an opening and closing structure of an icemaker case of a refrigerator, in which an icemaker door is selectively restricted by a lever assembly rotating perpendicular to an opening and closing direction of the icemaker door that selectively screens an icemaker case.

Technical Solution

In one embodiment, a refrigerator includes: an icemaker case on a door; an icemaker door on the icemaker case, the icemaker door being rotatable; a holding part on the icemaker case; and a lever assembly coupled to the icemaker door to be rotatable in order to engage or disengage with the holding part.

The lever assembly may include: a handle on an outer surface of the icemaker door; a lever extending from the handle and coupled to the icemaker door to be rotatable; and a protrusion part extending from the lever, and engaging or disengaging with the holding part of the icemaker case by rotating the handle.

The handle may rotate perpendicular to open and close directions of the icemaker door.

The lever may extend from one side of the handle and is bent over toward the holding part.

The protrusion part may be bent over at the end portion of the lever.

The refrigerator may further include a fixing bracket for allowing the lever to rotate in the icemaker door.

A portion of the handle may be bent over to be spaced from the outer surface of the icemaker door.

The refrigerator may further include a stopper on both sides of the lever, the stopper allowing the lever to rotate within a predetermined angular range.

The refrigerator may further include a disengagement preventing member on the outside of the lever, the disengagement preventing member preventing the lever from being disengaged from the icemaker door.

One side of the holding part may be formed slant to allow the icemaker door to be pulled toward the icemaker case when the protrusion part rotates to engage with the holding part.

The refrigerator may further include a holding groove on one side of the holding part, the holding groove preventing the protrusion part from moving when the protrusion part is inserted into the holding part.

The refrigerator may further include a cover on the icemaker door, the cover covering a portion of the lever.

The refrigerator may further include a gasket, the gasket coupled to the icemaker door to seal an inner space of the icemaker case when the door is closed.

The refrigerator may further include a cool air duct, the cool air duct being connected to the icemaker case when the door is closed.

The cool air duct may include: a supply duct supplying cool air to the icemaker case; and a discharge duct discharging the cool air from the icemaker case.

The refrigerator may further include a damper on the cool air duct, the damper preventing cool air supplying when the door is open.

The refrigerator may further include a refrigeration compartment on the upper part of a main body of the refrigerator, the refrigeration compartment including a cool air duct.

Advantageous Effects

According to an embodiment, an icemaker is installed in a door of a refrigerator, such that a user does not need to stoop to get ice in a case where a refrigeration compartment is disposed on the upper part of the refrigerator.

According to an embodiment, although a door of a refrigeration compartment receives impacts from the left and right directions while opening and closing the door, an icemaker door is not opened or closed due to an impact of opening and closing the door of the refrigeration by operating a lever assembly of the icemaker door up and down to open and close the icemaker door.

According to an embodiment, since an icemaker door is not opened due to the impact of a door of a refrigeration compartment, a refrigerator does not cool its contents below a target temperature ("below a target temperature" may be caused by cool air of an icemaker case, which flows into the refrigeration compartment). Accordingly, the contents stored in the refrigeration compartment do not freeze and ice in the icemaker does not melt.

BEST MODE FOR CARRYING OUT THE INVENTION

Reference will now be made in detail to the embodiments of the present disclosure, examples of which are illustrated in the accompanying drawings. However, the idea of the present disclosure is not limited to an embodiment, and another embodiment within the range of the present disclosure of retrogressive another present disclosure may be easily provided by addition, modification, and deletion of another components.

Figure 1:
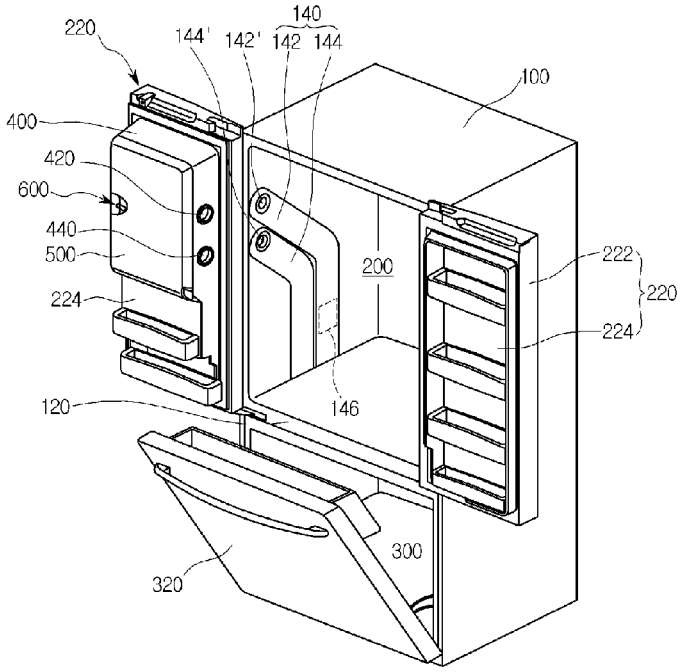
FIG. 1 is a perspective view of a refrigerator according to an embodiment.

FIG. 1 is a perspective view of a refrigerator according to an embodiment.

Referring to FIG. 1, the inside in a main body 100 of the refrigerator is divided into the top portion and bottom portion by a barrier 120. A refrigeration compartment 200 is disposed above the barrier 120 to keep its contents cool, and a freezer 300 is disposed below the barrier 120 to keep its contents frozen.

There are a plurality of drawers and shelves for efficiently storing the contents in the refrigeration compartment 200 and the freezer 300, and various sizes of storage spaces are additionally formed if necessary.

A freezer door 320 is installed at the open front of the freezer 300 to open and close the freezer 300. The tilting type freezer door 320 opens in a frontal direction, with its upper end rotating outward within a predetermined angular range about an axis at the bottom end of the freezer 300. The description relating to a tilting structure of the freezer door 320 will be omitted for conciseness.

Baskets or drawers are installed at the freezer door 320 to store contents below a freezing point.

A cool air duct 140 is installed in the inner side surface of the main body 100 to guide the flow of cool air. The cool air duct 100 includes a supply duct 142 and a discharge duct 144. The supply duct 142 provides cool air from the freezer 300 into an icemaker case 400. The discharge duct 144 guides the cool air from the icemaker case 400 into the freezer 300. The supply duct 146 further includes a damper 146 that prevents the supply duct 146 from supplying the cool air when a refrigeration compartment door is open.

The end portions of the supply duct 142 and the discharge duct 144 are exposed at the inner side surface to form a main body discharge port 142' and a main body inlet port 144' respectively. The main discharge port 142' discharges the cool air guided through the supply duct 142, and the main body inlet port 144' suctions the cool air discharged from the icemaker case 400 into the discharge duct 144.

Additionally, since the other end portions of the supply duct 142 and the discharge duct 144 are connected to the inside of the freezer 300, the cool air circulates between the freezer 300 and the icemaker case 400.

The open front of the refrigeration compartment 200 is opened and closed by the refrigeration compartment door 220. The refrigeration compartment doors 220 are installed to be respectively rotatable toward the left and right of the main body 100.

An outer case 222 is disposed on the front of the refrigeration compartment door 220, and an inner case is disposed on the rear of the refrigeration compartment door 220. An insulating material such as foamy polyurethane is filled between the outer case 222 and the inner case 224.

The icemaker case 400 is disposed at the refrigeration compartment door 220. The icemaker case 400 protrudes toward the refrigerator to form an ice making compartment. The icemaker case 400 may be coupled to the inner case 224, or the icemaker case 400 and the inner case 224 may be manufactured in an integral type.

A door inlet port 420 and a door discharge port 440 are respectively formed at the side of the icemaker case 400. The door inlet port 420 and the door discharge port 440 are formed in order to contact the main body discharge port 142 and the main body inlet port 144 while the refrigeration compartment door 220 is closed, such that the cool air duct 140 is connected to the icemaker case 400. At this point, the door inlet port 420 is connected to the main body discharge port 142' and the door discharge port 440 is connected to the main body inlet port 144'.

The inside of the icemaker case 400 includes an icemaker (not shown) for making ice, an ice bank (not shown) for storing and providing ice, and an ice transferring device (not shown) for transferring ice. Additionally, a dispenser (not shown) may be disposed at the front of the refrigeration compartment door 220 for dispensing ice from the ice bank (not shown) into the outside. Once again, the ice maker, the ice maker, the ice bank, and the ice transferring device are not shown in FIG. 1.

The icemaker door 500 is mounted at the icemaker case to be rotatable. The icemaker door 500 having the upper part and lower part at the right side, which are hinged on the icemaker case 400, selectively opens and closes the open front of the icemaker case 400 by rotating the icemaker door 500.

While the icemaker door 500 is closed, the outline of the icemaker case 400 and the rear outline of the icemaker door 500 contact each other to seal the icemaker case 400, and also a gasket 520 is installed along the rear outline of the icemaker door 500 to prevent the leakage of cool air.

Moreover, a lever assembly 600 is disposed in the icemaker door 500 to attach and detach the icemaker door 500 to and from the icemaker case 400.

Figure 2:
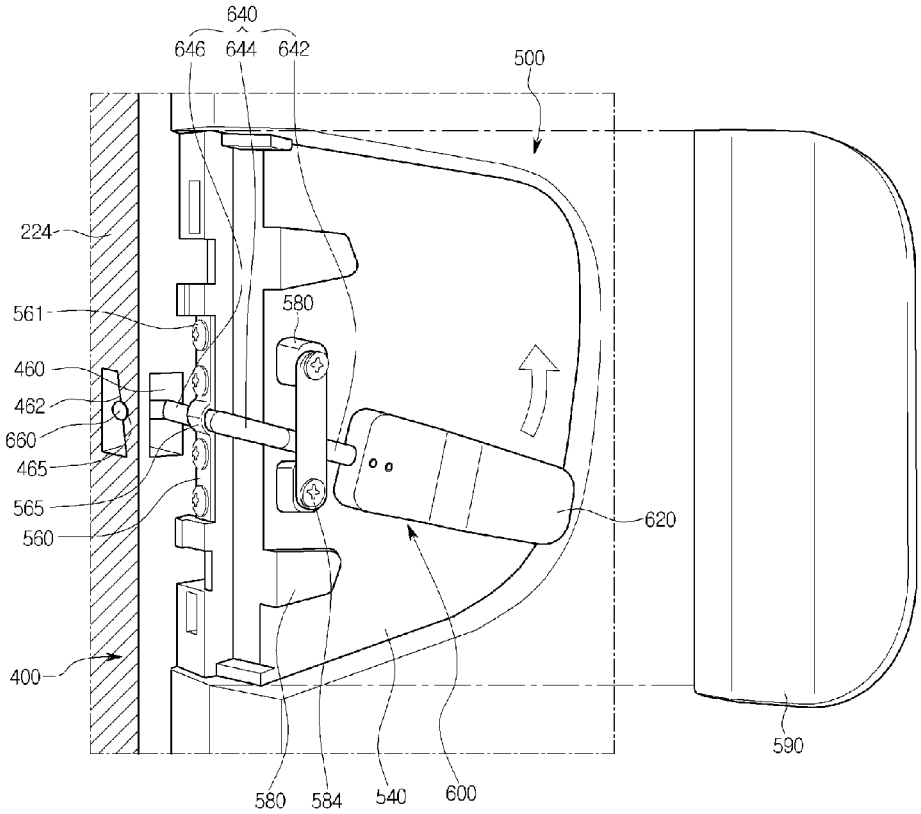
FIG. 2 is a perspective view of a lever assembly opening and closing an icemaker door of the refrigerator of FIG. 1.
Figure 3:
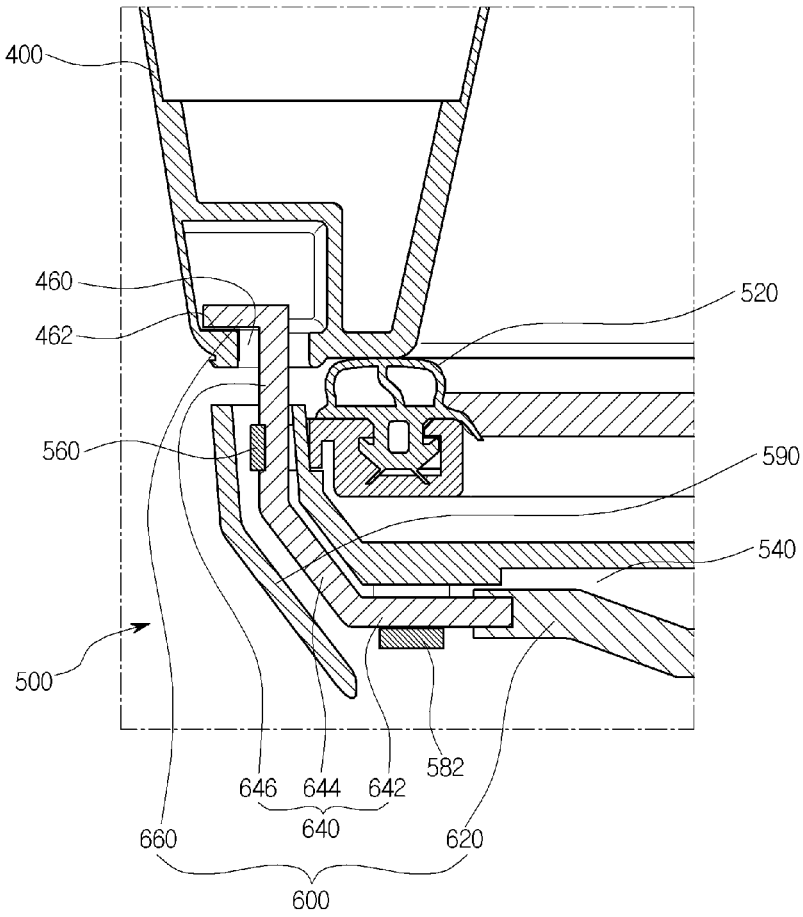
FIG. 3 is a sectional view of an icemaker door and an icemaker case of FIG. 2 restricted by a level assembly.

FIG. 2 is a perspective view of the lever assembly 600 opening and closing the icemaker door 500 of the refrigerator of FIG. 1. FIG. 3 is a sectional view of the icemaker door 500 and the icemaker case 400 of FIG. 2 restricted by the lever assembly 600.

Referring to FIGS. 2 and 3, a mounting part 540 to which the lever assembly 600 is attached is formed at the left of the icemaker door 500. The mounting part 540 is depressed toward the bottom in a semicircular shape, and the depressed range is greater than the rotation range of the lever assembly 600.

The lever assembly 600 is mounted to be rotatable in up and down directions perpendicular to the open and close directions of the icemaker door 500.

The lever assembly 600 includes a handle 620 disposed outward the icemaker door 500, a lever 640 extending from the handle 620, and a protrusion part 660 extending from the lever 640.

The handle 620 is disposed to be exposed to the outer of the mounting part 540. The handle 620 is bent toward the front to be spaced from one side of the mounting part 540, such that a user can easily grab the handle 620.

The lever 640 is bent toward a holding part 460 of the icemaker case 400. At this point, the lever 640 includes a first extension part extending toward the left of the handle 620, a second extension part 644 perpendicularly bent with a predetermined angle from the first extension part 642, and a third extension part 646 bent perpendicular to the first extension part 642 from the second extension part 644. The lever 640 may be in a thin and long pole shape or a plate shape.

The protrusion part 660 is formed perpendicular to the third extension part 646 of the lever 640. The protrusion part 660 rotates inside the holding part 460 of the icemaker case 400 according to control of the handle 620 for locking and unlocking. The protrusion part 660 prevents the icemaker door 500 from being opened when the protrusion part 660 is restricted by the holding part 460.

The protrusion part 660 is formed by mounting an additional member to the third extension part 646, or by bending the end portion of the third extension part 646. Additionally, the length of the protrusion part 660 may be formed smaller than the opened size of the holding part 460.

The lever 640 is fixed at the icemaker door 500 by using a fixing bracket 560. At this point, an insertion part with a semicircular form is formed at the center of the fixing bracket 560 to allow the third extension part 646 to be rotatable. Additionally, the fixing bracket 560 prevents the lever 640 from being disengaged and allows it to rotate.

A stopper 580 may be formed at the mounting part 540 of the icemaker door 500 for allowing the lever 640 to rotate within a predetermined angular range. The stoppers 580 are spaced a predetermined distance apart from each other at the both sides of the first extension part 642, and protrudes with a predetermined height at the mounting part 540.

At this point, the protruding height of the stopper 580 may be higher than the first extension part 642 of the lever assembly 600. Accordingly, the first extension part 642 is restricted by the stopper 580 when the lever assembly 600 rotates.

Additionally, a disengagement preventing member 582 is coupled to the outer surface of the stopper 580 to prevent the lever 640 from disengaging from the icemaker door 500. At this point, the disengagement preventing member 582 is coupled to the top of the stopper 580 by using a coupling member 584. The disengagement preventing member 582 is in a thin and long plate form.

A cover 590 is attached to the mounting part 540 to cover a portion of the lever assembly 600. The cover 590 covers a portion of the lever 649, the fixing bracket 560, and the disengagement preventing member 582.

The inside of the holding part 460 includes a space broader than the opened surface of the holding part 460, such that the protrusion part 660 is rotatable. The opened surface of the holding part 460 has a form extending in the top and down directions by the protruding length of the protrusion part 660 and extending in the right and left directions with a relatively narrow width. Accordingly, when the protrusion part 660 rotates in the holding part 460, it is restricted by the holding part 460 and stays at the inside of the holding part 460.

Moreover, the inner surface of the holding part 460 is formed slant to pull the icemaker door 500 toward the icemaker case 400 when the protrusion part 660 rotates for engagement. At this point, a holding groove 465 may be formed at the inner surface 461 of the holding part 460 to prevent the protrusion part 660 from moving when the protrusion part 660 is coupled to the holding part 460.

An operation of an embodiment having the above components is described below.

When power is applied from the external, the refrigeration compartment 200 and the freezer 300 maintains a predetermined low temperature by means of a cooling cycle. A portion of cool air supplied to the inner of the freezer 300 is supplied to the icemaker case 400 through the supply duct 142, such that ice can be made inside the icemaker case 400. The temperature of the cool air at the icemaker case 400 increases, such that the cool air returns to the freezer 300 through the discharge duct 144. Due to the cool air circulation, ice is made inside the icemaker case 400.

Figure 4:
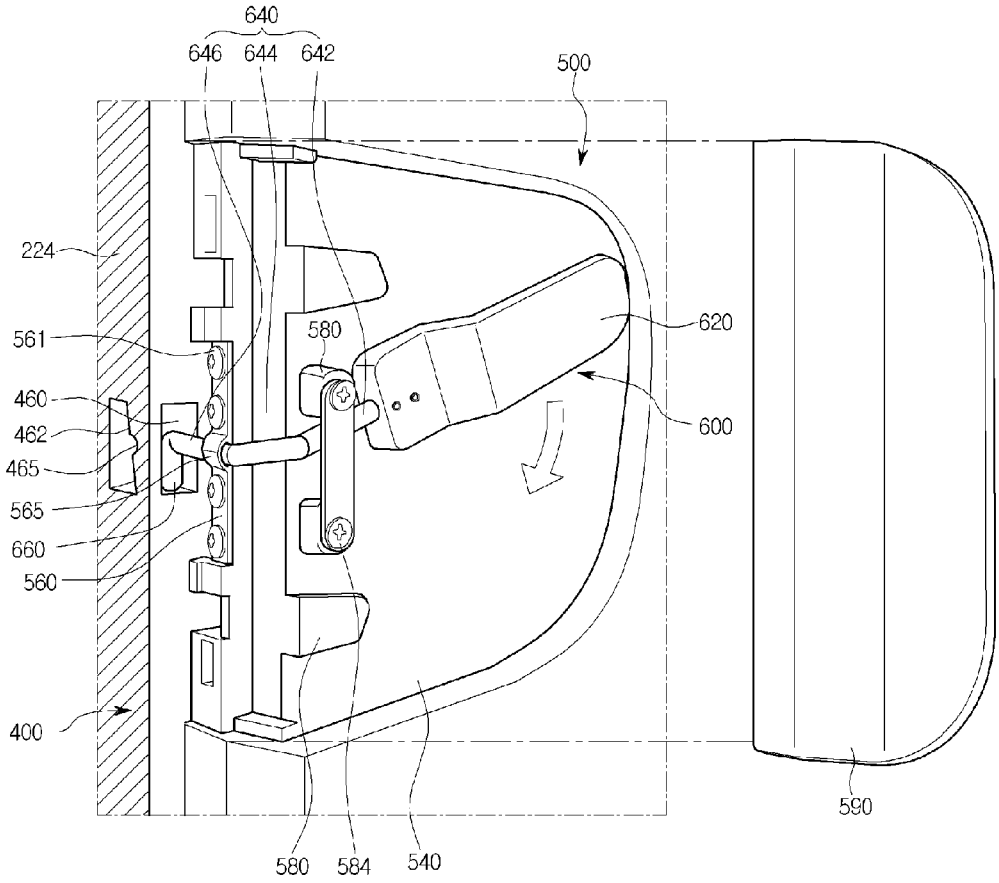
FIG. 4 is a perspective view of when the lever assembly of FIG. 2 releases an icemaker door.

FIG. 4 is a perspective view of when the lever assembly 600 of FIG. 2 releases the icemaker door 500.

Referring to FIG. 4, the handle 620 rotates toward the upper for opening the icemaker door 500. At this point, the lever assembler 600 rotates using the third extension part 646 fixed by the fixing bracket 560 as an axis. Additionally, when the handle 620 rotates with a predetermined angle, the first extension part 642 of the lever 640 engages with the upper portion of the stopper 580, such that the lever assembly 640 does not rotate beyond the upper portion.

When the handle 620 rotates up to the opening position, the protrusion part 660 freely enters and leaves the opened portion of the holding part 460. The protruding direction of the protruding part 660 is toward the bottom to correspond to the opened form of the holding part 460, and at this point, the space in the up and down directions of the holding part 460 is greater than the protruding protrusion part 660, such that the protrusion part 660 can freely enters and leaves the holding part 460 without restriction.

Figure 5:
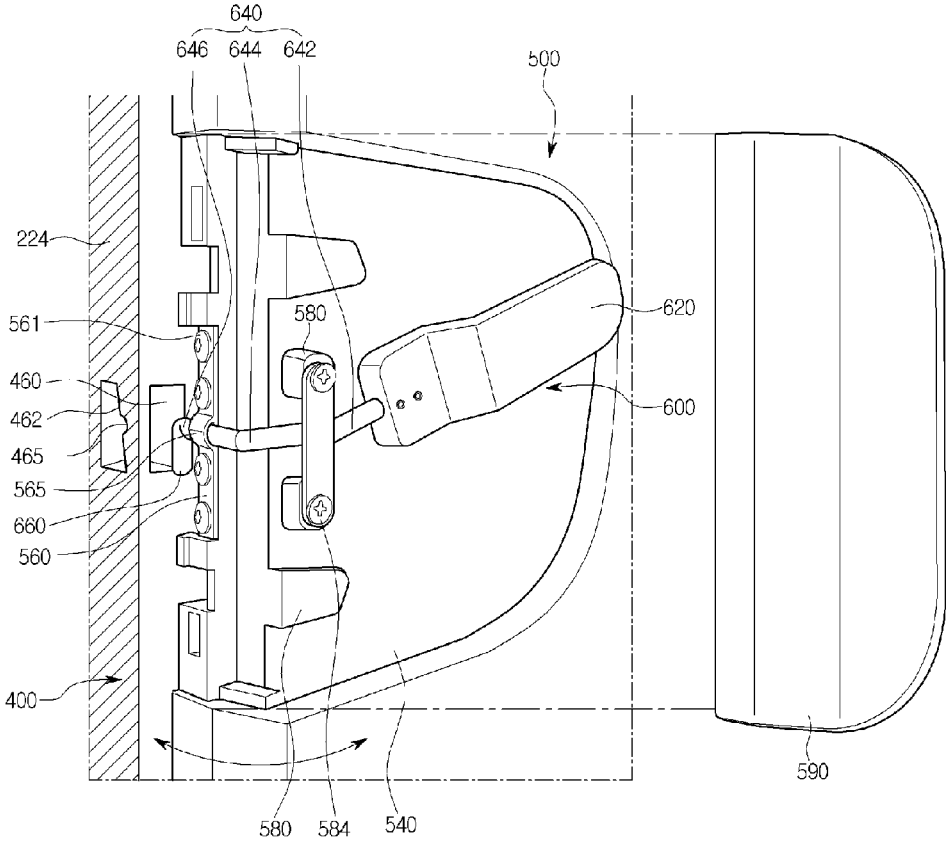
FIG. 5 is a perspective view of when the icemaker door of FIG. 2 is open.

FIG. 5 is a perspective view of when the icemaker door is open.

Referring to FIG. 5, when the icemaker door 500 is pulled, the protrusion part 660 releases from the opened portion of the holding part 460.

Then, the icemaker door 500 rotates toward the icemaker case 400. At this point, the handle 620 is located at the opening position. The icemaker door 500 rotates furthermore, and the protrusion part 660 is inserted into the inside of the holding part 460 as illustrated in FIG. 4.

When the protrusion part 660 is inserted into the holding part 460 and the handle 620 rotates toward the bottom, the handle 620 is positioned at the closing position. At this point, since the lever assembly 600 rotates using the third extension part 646 of the lever 640 as an axis, the protrusion part 660 bent toward a direction corresponding to the handle 620 at the bottom of the third extension part 646 rotates toward the top. Additionally, since the first extension part 642 of the lever 640 is restricted by the stopper 580 at the lower part, the lever assembly 600 does not rotate toward the bottom.

Referring to FIG. 2, when the protrusion part 660 rotates while being inserted in the holding part 460, it contacts the inner surface 462 of the holding part 460 and its contact between them increases. According to the contact between protrusion part 660 and the inner surface 462, the icemaker door 500 is pulled toward the icemaker case 400. Additionally, when the protrusion part 660 is placed on the holding groove 462 of the holding part 460, it does not fall into the holding groove 462.

At this point, the gasket 520 formed along the outline of the icemaker door 500 is compressed according to the contact of the icemaker door 500, such that the icemaker door 500 and the inner case 224 forming the outline of the icemaker case 400 completely contact each other in order to seal the inner space of the icemaker case 400.

On the other hand, when the protrusion part 660 completely rotates by continuously rotating the handle 620, the protrusion part 660 faces toward a direction perpendicular to the opened portion of the holding part 460. At this point, since the protrusion part 660 and the inner surface of the holding part 460 engage with each other, the protrusion part 660 is not easily disengaged from the holding part 460 and maintains its engagement with the holding part 460. Accordingly, the icemaker door 500 maintains its closed state.

INDUSTRIAL APPLICABILITY

In the refrigerator according to the embodiment, although its freezer is disposed on the lower part of the main body, a user does not need to stoop for getting ice, and since the icemaker door does not open by the impact of when the refrigerating door is opened and closed, the refrigerator can be used for industrial purpose.

The invention claimed is:

1. A refrigerator comprising:

a main body having a refrigeration compartment and a freezer;

a first door to open or close the refrigeration compartment;

a case disposed on the first door, the case formed by a wall part which protrudes at a rear edge portion of the first door to establish a chamber for storing ice;

a second door rotatably coupled to the wall part of the case to selectively open the chamber;

a gasket installed along an edge of a rear surface of the second door, the gasket configured to contact the wall part when the second door is in a closed position, in order to prevent leakage of cool air in the chamber of the case when the first door is in an opened position;

a holding part recessed into the wall part of the case, the holding part including an inclined inner surface;

a lever assembly coupled to the second door to open or close the second door, the lever assembly comprising:

a handle configured to extend and rotate along a front surface of the second door;

a first part extending from an end of the handle along the front surface of the second door;

a second part bent from an end of the first part along a side surface of the second door; and a protrusion part bent and extending from an end of the second part to be selectively hooked to the holding part; and a fixing bracket covering a portion of an outer surface of the second part and fixed to the side surface of the second door, wherein the second part rotates to be a rotational axis of the lever assembly, wherein when the handle rotates to close the second door, the protrusion part rotates to contact and move along the inclined inner surface of the holding part, to press the gasket to the wall part.

2. The refrigerator according to claim 1, wherein the rotational axis of the lever assembly is configured to be perpendicular to the front surface of the second door.

3. The refrigerator according to claim 1, wherein a portion of the handle is bent over to be spaced from the front surface of the second door.

4. The refrigerator according to claim 1, further comprising stoppers allowing the handle to rotate within a predetermined angular range, wherein the stoppers include:

a first stopper to limit an upward rotation of the handle; and a second stopper independently located at a position a predetermined distance downward from the first stopper to limit a downward rotation of the handle.

5. The refrigerator according to claim 4, further comprising a disengagement preventing member connecting upper ends of the stoppers, wherein the first part of the handle is configured to pass through a space formed by the stoppers and the disengagement preventing member.

6. The refrigerator according to claim 1, further comprising a holding groove formed in the inclined inner surface of the holding part, the holding groove preventing the protrusion part from moving when the protrusion part is inserted into the holding part.

7. The refrigerator according to claim 1, further comprising a cover disposed on the second door, the cover covering a portion of the lever assembly.

* * * * *